United States Patent [19]

Sun

[11] Patent Number: 4,897,319

[45] Date of Patent: Jan. 30, 1990

[54] TFEL DEVICE HAVING MULTIPLE LAYER INSULATORS

[75] Inventor: Sey-Shing Sun, Beaverton, Oreg.

[73] Assignee: Planar Systems, Inc., Beaverton, Oreg.

[21] Appl. No.: 221,440

[22] Filed: Jul. 19, 1988

[51] Int. Cl.[4] ..... H05B 33/12

[52] U.S. Cl. ..... 428/690; 428/917; 313/509; 427/66

[58] Field of Search ..... 313/509; 428/690, 691, 428/917; 427/66

[56] References Cited

U.S. PATENT DOCUMENTS

| | | | |
|---|---|---|---|
| 4,188,565 | 2/1980 | Mizukami et al. . | |
| 4,547,703 | 10/1985 | Fujita et al. . | |
| 4,721,631 | 1/1988 | Endo et al. | 427/66 |
| 4,774,435 | 9/1988 | Levinson | 313/509 |

OTHER PUBLICATIONS

Kobayashi, et al., "Thin Film ZnS:Mn Electroluminescent Device," IEEE Transactions on Electron Devices, vol. Ed-29, No. 10, Oct. 1982.

Mita, et al., "ZnS:Mn Thin Film Electroluminescent Devices Having Doubly-Stacked Insulating Layers," Japanese Journal of Applied Physics, vol. 26, No. 5, May 1987, pp. L541-L543.

Ohwaki, et al., "Stacked Insulator Structure Thin-Film Electroluminescent Display Devices," Abstract No. 1222, Electrochemical Society Meeting, Honolulu, HI, Oct. 1987.

Kozawaguchi, et al., "Thin-Film Electroluminescent Device Employing $Ta_2O_5RF$ Sputtered Insulating Film," Japanese Journal of Applied Physics, vol. 21, No. 7, Jul. 1982, pp. 1028-1031.

*Primary Examiner*—Nancy A. B. Swisher

*Attorney, Agent, or Firm*—Chernoff, Vilhauer, McClung & Stenzel

[57] ABSTRACT

A structure for a thin-film electroluminescent (TFEL) device includes an EL phosphor layer sandwiched between a pair of insulator stacks, at least one of the stacks including a thin layer of silicon oxynitride in direct contact with the last grown side of the phosphor layer and a second thicker layer of barium tantalate. The silicon oxynitride layer has high resistivity, and when combined with a second insulator having a high dielectric constant, such as barium tantalate, produces an increase in luminance of the phosphor layer at conventional voltages. Both insulator stacks may include a silicon oxynitride layer, but this layer is in contact only with the last grown side of the EL phosphor layer. On the other side of the EL phosphor layer the high dielectric constant layer lies between the silicon oxynitride and the EL phosphor layer.

8 Claims, 2 Drawing Sheets

TFEL DEVICE HAVING MULTIPLE LAYER INSULATORS

The following invention relates to a laminar stack structure for a thin film electroluminescent (TFEL) device in which the insulators sandwiching an electroluminescent phosphor layer each comprise multiple layers of dielectric material having differing resistivities and dielectric constants to provide increased luminance and high efficiency.

BACKGROUND OF THE INVENTION

TFEL devices comprise a laminar stack of thin films deposited on a glass substrate. The thin films include a first transparent electrode layer and an electroluminescent (EL) phosphor structure comprising an electroluminescent phosphor material sandwiched between a pair of insulators. A rear electrode layer completes the laminar stack. In matrix-addressed TFEL panels, the electrodes are driven by row and column drivers, respectively, and light is produced at the points of intersection between the front and rear electrodes due to the creation of a high-intensity electric field.

It has long been a desirable object in the design of such devices to maximize the luminance of the panel while at the same time conserving energy. Considerable power is required for creating electric fields of intensities which are high enough to cause enough light emission for clear viewing. In the past, a considerable amount of effort has been directed toward designing electroluminescent structures which consume less power and yet provide high luminance.

Some approaches have included the use of multiple layer insulators sandwiching the electroluminescent phosphor film. In particular, one approach has been to use a double layer insulator where one of the layers functioned as a carrier injection layer. In theory, a carrier injection layer augments the number of free electrons available at the interface between the EL phosphor layer and the insulating layer. These electrons enhance the electroluminescent properties of the phosphor layer at lower threshhold voltages, and an example of such an approach is shown in "ZnS:Mn Thin Film Electroluminescent Devices Having Doubly-Stacked Insulating Layers," Mita et al., *Japanese Journal of Applied Physics*, Vol. 26, No. 5, May 1987, pp. L541–L543. According to this article, an electroluminescent layer comprising ZnS:Mn is sandwiched between a doubly-stacked insulating layer comprising $Ta_2O_5$ and $SiO_2$. While in theory this approach has appeared to be attractive, in actual practice, the presence of a carrier injection layer, which presumes an insulating material having relatively low resistivity, degrades the polarization charge field created at the interface between the EL layer and the insulator which is essential for high efficiency operation. Kobayashi, et al. in "Thin Film ZnS:Mn Electroluminescent Device," *IEEE Transactions On Electron Devices*, Vol. Ed-29, No. 10, October 1982, proposes a germanium semiconductor layer adjacent the ZnS:Mn layer to provide a carrier injection function. This study found, however, that at higher voltages, the luminance of the panel was lower than in devices having conventional structures. Also, breakdown was a problem at voltages close to the saturation value. The one advantage of the germanium layer was that it was black, thereby providing an increase in contrast under high ambient light conditions. Another stacked insulator device is shown in the paper entitled "Stacked Insulator Structure Thin Film Electroluminescent Display Devices", Ohwaki, et al., Abstract No. 1222, Electrochemical Society Meeting, Honolulu, HI, October 1987. This paper discloses the use of a stacked insulator structure in a TFEL laminate comprising Al/-$SiO_2$/$Ta_2O_5$/$SiO_2$/ZnS;Mn/$Ta_2O_5$/$SiO_2$/ITO/glass. The silicone dioxide functions as a carrier injection layer and accordingly has a low resistivity. This device proved not to be as efficient as a conventional TFEL device because it required a higher threshhold voltage for luminescence.

The use of silicon oxynitride (SiON) as a layer in a doubly-stacked dielectric has been proposed in Mizukami et al., U.S. Pat. No. 4,188,565. According to this reference, the function of the SiON is to bond a second dielectric layer, which may be $SiO_2$ or $Ta_2O_5$ on the front, and $Al_2O_3$ or $Ta_2O_5$ on the back, to the EL layer. The SiON is placed against the ZnS:Mn film on both sides which may cause degradation of the polarization charge and lower the luminance of the panel.

The aforementioned references make it clear that the double-stacked insulator structure has serious deficiencies where the insulator-EL interface is designed as a carrier injection layer and includes a material of relatively low resistivity.

SUMMARY OF THE INVENTION

The present invention provides a thin film electroluminescent laminate comprising an electroluminescent layer sandwiched between a pair of dielectric thin-film stacks where at least a first one of the layers in the dielectric thin-film stack is a film of silicon oxynitride or other high resistivity material placed in contact with the EL layer. The silicon oxynitride layer is thin compared to the second insulator which may be, for example, barium tantalate. Thus, the silicon oxynitride layer has a small dielectric constant relative to the rather large dielectric constant provided by the barium tantalate.

The silicon oxynitride, or high resistivity layer, may have a thickness of between 200 Å and 400 Å. While both dielectric insulator stacks include layers of barium tantalate and silicon oxynitride, the silicon oxynitride layer is in contact with only the last grown side of the EL layer. On the other side of the EL layer, it is the barium tantalate that is in contact with the electroluminescent layer and the silicon oxynitride layer is disposed between the barium tantalate layer and the front electrodes.

Superior brightness versus voltage characteristics have been observed with the use of the aforementioned insulator structure along with higher efficiency. The precise reason for this improvement in operating characteristics is unknown, but it is likely that the thin layer of silicon oxynitride, having high resistivity, which is deposited next to the last grown side of the luminescent layer, serves as an electron acceleration layer. Electrons trapped at the interface of the silicon oxynitride/barium tantalate layer are accelerated by the high electric field across the silicon oxynitride and enter the luminescent layer with high energy. These high energy electrons provide for luminescent center excitation which leads to the observed improvement in the luminescent efficiency and intensity. In addition, the use of a layer having a high dielectric constant (i.e., the barium tantalate layer) allows the device to be operated at a lower voltage and provides high reliability with a lower propensity for breakdown.

It is a principal object of this invention to provide a TFEL panel having high luminance and efficiency.

A further object of the invention is to enhance the luminance of an EL phosphor in a TFEL panel by sandwiching the phosphor between insulator stacks that include silicon oxynitride and barium tentalate.

Yet a further object of this invention is to provide a stacked insulator structure for an EL phosphor layer in a TFEL panel which includes a high resistivity layer of a low dielectric constant and a layer having a high dielectric constant to increase the brightness of the panel without the need for increasing the driving voltage.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 1:
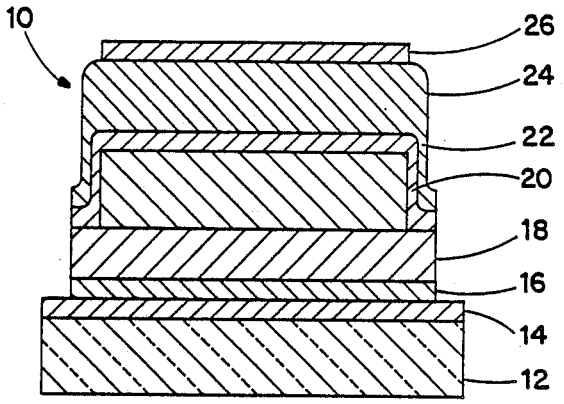
FIG. 1 is a sectional view of a TFEL device constructed according to the present invention.

A TFEL laminate structure 10 includes a glass substrate 12 and a first electrode layer composed of transparent indium tin oxide (ITO) 14. An insulator stack includes a thin layer of silicon oxynitride (SiON) 16 having a thickness of between 100 and 200 Å and a thicker layer of barium tantalate (BTO) 18 having a thickness of between 3000 and 4000 Å both deposited by RF sputtering. An electroluminescent phosphor 20 such as ZnS:Mn is deposited by thermal evaporation at 230° C. to a thickness of 5600 Å on the BTO layer 18. In contact with the last grown side of the electroluminescent layer 20 is a thin layer of SiON (200–400 Å) 22 which forms part of another insulator stack, the second component of which is a second thick layer of BTO (3000–4000 Å) 24. The dielectric constant of the SiON layers is 6 while the dielectric constant for the BTO layers is 23. The resistivity of the BTO layers is $10^{14}\Omega$-cm and for SiON ranges from $10^9$ (for 100 Å SiON) to $10^{13}$ (for 400 Å SiON)$\Omega$-cm. The device is completed with a second electrode layer 26 which may be made of aluminum. (This layer is shown in FIG. 1 as solid, but in actuality consists of a plurality of electrodes oriented perpendicular to ITO electrodes 14.)

Figure 2:
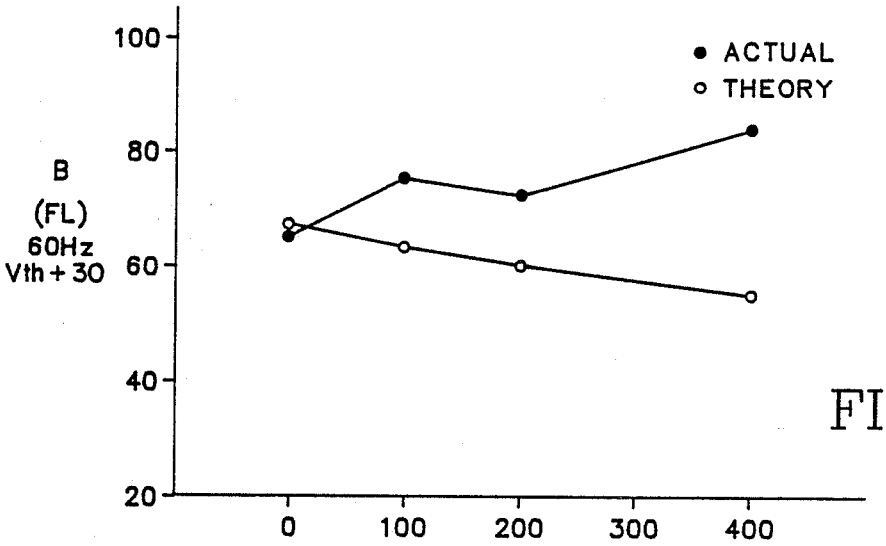
FIG. 2 is a graph showing the difference between theoretically calculated values and actual values measured for brightness at various thicknesses of the rear silicon oxynitride layer in FIG. 1.
Figure 3:
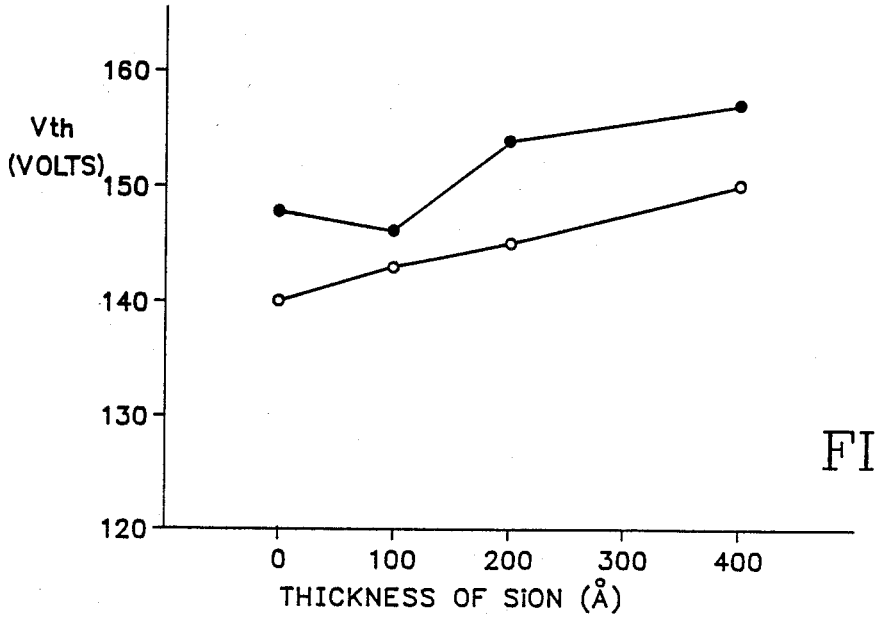
FIG. 3 is a graph showing the difference between theoretically calculated values and actual values measured for threshold voltage at various thicknesses of the rear silicon oxynitride layer in FIG. 1.
Figure 4:
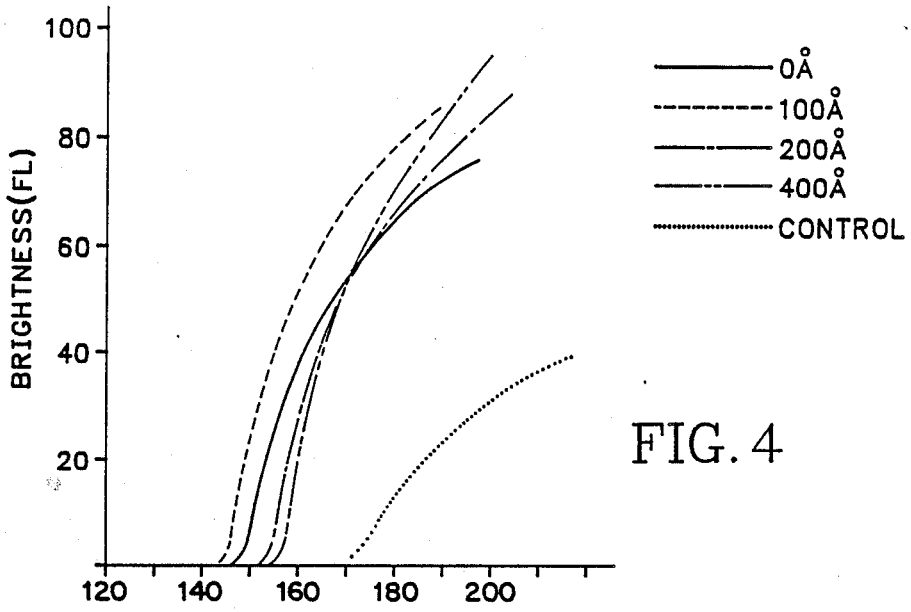
FIG. 4 is a graph showing the relationship between brightness and voltage for several thicknesses of the rear silicon oxynitride layer in the device of FIG. 1.

The performance of the TFEL device in FIG. 1 is illustrated in FIGS. 2–5. FIG. 4, for example, shows the brightness versus voltage characteristic of the device of FIG. 1 for various thicknesses of the rear silicon oxynitride layer 22. This layer is deposited adjacent the last grown side of the ZnS:Mn electroluminescent film 20. This structure is compared with a 0 Å device (the unbroken line) which includes only BTO layers sandwiching an EL film layer of ZnS:Mn with no silicon oxynitride interposed between either of the BTO insulators and the EL layer. A control device (not shown) illustrates the performance of a TFEL structure having sandwiching layers of SiON insulators and no BTO.

FIG. 4 illustrates that the brightness is much higher for the device of FIG. 1 than for either the control device or the 0 Å version. As the graph shows, at a voltage of 180–200 volts, the layered insulator structure of FIG. 1 is nearly twice as bright as the control device, and is 20–25 Fl brighter than 0 Å.

Figure 5:
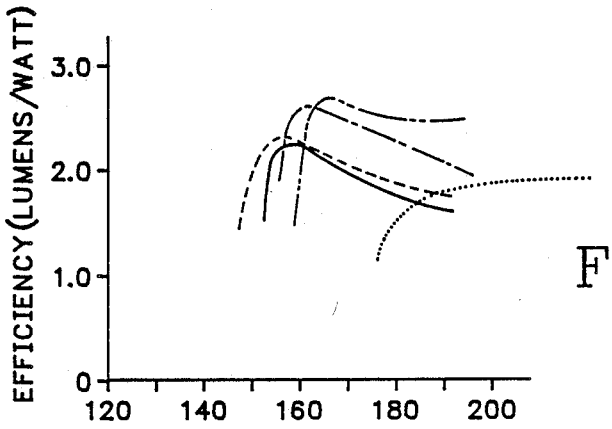
FIG. 5 is a graph showing the relationship between efficiency and voltage for several thicknesses of the rear silicon oxynitride layer in the device of FIG. 1.

FIG. 5 shows that efficiency is higher as well, and that the efficiency peak occurs at a lower voltage. Each of the different thicknesses of the SiON layer is more efficient than the control structure which requires 180–200 volts for an efficiency below 2.0. By contrast, the efficiencies of the SiON insulator devices range from 2.2 to 2.5 at voltages centered around 160 volts.

The thickness of the rear SiON layer 22 is also a factor, as shown in FIG. 4, with the steepest brightness versus voltage curve shown for the thicker (400 Å) SiON layer. Initially, the version having the thinner SiON layer is brighter, but as the voltage exceeds 165 volts, the laminate having the 400 Å thickness becomes increasingly brighter.

Theoretically, brightness should decrease as the thickness of the layer 22 increases, however, FIG. 2 shows that between 200 Å and 400 Å, the brightness actually increases, reaching a maximum at 400 Å.

The relationship between the thickness of the silicon oxynitride layer and the voltage threshold characteristics is shown in FIG. 3. As shown in FIG. 3, threshhold voltages are somewhat higher than expected for the SiON insulator sturcture of FIG. 1, but overall efficiency is better than for conventional TFEL laminates.

The precise reason for the improved brightness and efficiency, which seems to increase for SiON layers between 200 Å and 400 Å deposited on the last grown side of the EL phosphor layer, is not known. However, one possible explanation is that the high resistivity of a silicon oxynitride layer which is 400 Å thick and which has a low dielectric constant, provides an electron "acceleration layer." The high resistivity of the silicon oxynitride provides a high polarization electric field at the EL phosphor/insulator interface and at the same time, the high dielectric constant of the BTO insulator layer insures that lower voltages may be used to provide a high internal electric field. The electrons at the interface between the two insulators tunnel through the SiON layer and arrive at the EL phosphor layer with high kinetic energy. It is believed that brightness is in part a function of the energy of the electrons hitting the luminescent Mn centers in the EL phosphor layer. This contributes, therefore, to a significant improvement in the luminance obtainable for given voltages.

The position of the high resistivity layer is also important. For high energy electrons, most of their energy is lost during the first 1,000–2,000 Å of travel. Since the crystal structure of the last grown side of the EL phosphor layer is better developed, the effect of the high kinetic energy electrons is maximized on this side. By contrast, placing the silicon oxynitride layers on both sides of the EL phosphor layer results in a marked decrease in both luminance and efficiency due to decreased capacitance and an overall diminishing of the polarization charge field at the insulator/phosphor interface. For this reason, it would appear that a layer, which is highly resistive but provides low capacitance, deposited against the last grown side of the EL phosphor layer provides the best mechanism for impact excitation of the luminescent centers within the EL phosphor crystalline structure.

Based upon this principle it would be reasonable to expect that other combinations of insulator material could achieve the same results. For example, $Ta_2O_5$ and $SIO_2$ or $Ta_2O_5$ and $Al_2O_3$ could be used. However, the insulator layer next to the last grown side of the EL phosphor layer should be the insulator with the lowest dielectric constant and the highest resistivity so that a high field can be developed for electron tunnelling. The highly resistive, low capacitance layer should not be in contact with the EL phosphor layer on its other side. The other layer should have a high dielectric constant and will likely be thicker than the high resistivity layer. On the other side of the EL layer, the high resistivity dielectric film should be deposited against the ITO electrode and the thicker high dielectric film should be placed between the high resistivity film and the EL layer.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A thin film electroluminescent laminate comprising:

(a) a thin film layer of electroluminescent material;

(b) a first insulator stack comprising a high capacitance insulator layer and a thin film layer of silicon oxynitride, the silicon oxynitride layer being placed in contact with a first side of the thin film layer of electroluminescent material; and (c) a second insulator stack situated on a second side of the layer of thin film electroluminescent material opposite the first insulator stack and comprising a high capacitance insulator layer placed in contact with said second side of said thin film layer of electroluminescent material and a layer of silicon oxynitride.

2. The thin film electroluminescent laminate of claim 1 wherein the first insulator stack is placed against the last grown side of the thin film layer of electroluminescent material.

3. The TFEL laminate of claim 1 wherein the high capacitance insulator layers are made of barium tantalate.

4. A thin film electroluminescent laminate structure comprising a layer of thin film electroluminescent material sandwiched between a pair of multiple layer insulators wherein only one of said multiple layer insulators includes a layer of silicon oxynitride in contact with said layer of thin film electroluminescent material.

5. The thin film electroluminescent laminate structure of claim 4 wherein the pair of multiple layer insulators each include a first layer of high capacitance material and a second layer of material having high resistivity.

6. The thin film electroluminescent laminate structure of claim 4 wherein the layer of silicon oxynitride is in contact with the last grown side of the layer of thin film electroluminescent material.

7. A method of fabricating a thin film electroluminescent device comprising the steps of:

(a) placing a first electrode layer on a substrate;

(b) depositing a first highly resistive insulator layer on the first electrode layer;

(c) depositing a high capacitance insulator layer on top of the first highly resistive insulative layer;

(d) forming a layer of electroluminescent material on the high capacitance insulator layer;

(e) depositing a second highly resistive insulative layer on top of the layer of electroluminescent material;

(f) depositing a second high capacitance insulative layer on top of the second highly resistive insulative layer; and (g) placing a second electrode layer on top of the second high capacitance insulative layer.

8. The method of claim 7 wherein the second highly resistive insulative layer is formed from silicon oxynitride.

* * * * *

UNITED STATES PATENT AND TRADEMARK OFFICE

CERTIFICATE OF CORRECTION

PATENT NO. : 4,897,319

DATED : January 30, 1990

INVENTOR(S) : SEY-SHING SUN

It is certified that error appears in the above-identified patent and that said Letters Patent is hereby corrected as shown below:

Column 2, line 7, change "ZnS;Mn" to --ZnS:Mn--.

Signed and Sealed this

Twenty-second Day of September, 1992

*Attest:*

DOUGLAS B. COMER

*Attesting Officer*

*Acting Commissioner of Patents and Trademarks*